United States Patent [19]

Diaz

[11] Patent Number: 5,013,370

[45] Date of Patent: May 7, 1991

[54] METHOD FOR LOCALIZATION OF TENSILE RESIDUAL STRESS AND PRODUCT PRODUCED THEREBY

[75] Inventor: Thomas P. Diaz, San Martin, Calif.

[73] Assignee: General Electric Company, San Jose, Calif.

[21] Appl. No.: 548,437

[22] Filed: Jul. 2, 1990

Related U.S. Application Data

[63] Continuation of Ser. No. 328,850, Mar. 27, 1989, abandoned.

[51] Int. Cl.[5] ..... C21D 1/00

[52] U.S. Cl. ..... 148/13; 148/902

[58] Field of Search ..... 148/13, 145, 127, 129, 148/902

[56] References Cited

U.S. PATENT DOCUMENTS

| | | | |
|---|---|---|---|
| 4,188,419 | 2/1980 | Detert et al. | 148/127 |
| 4,229,235 | 10/1980 | Matsuda et al. | 148/127 |
| 4,354,883 | 10/1982 | Terasaki | 148/127 |
| 4,772,336 | 9/1988 | Enomoto et al. | 148/127 |

OTHER PUBLICATIONS

"Environmental Crack Growth Measurement Techniques," Electric Power Research Institute, Report No. NP-2641, Nov., 1982.

*Primary Examiner*—S. Kastler

*Attorney, Agent, or Firm*—Robert R. Schroeder

[57] ABSTRACT

A metallic object is treated to produce tensile residual stress in a known localized area of the metallic object. A metallic object having at least one portion substantially free of tensile residual stress is provided, and a localized area adjacent to or a part of the tensile stress-free area is selected. The localized area is subjected to heating on one surface and cooling on the opposite surface. Upon cooling to ambient temperature, the known localized area has tensile residual stress. The localized area can have cracks formed therein by crack-promotion techniques, such as submersion in boiling magnesium chloride. The area can be tested by attaching electrodes and subjecting the area to a reversing direct current crack growth measurement procedure.

6 Claims, 2 Drawing Sheets

METHOD FOR LOCALIZATION OF TENSILE RESIDUAL STRESS AND PRODUCT PRODUCED THEREBY

This is a continuation of application Ser. No. 07/328,850, filed Mar. 27, 1989, now abandoned.

FIELD OF THE INVENTION

The present invention relates to a method for producing tensile residual stress in a metallic object and a metallic object so treated, and, in particular, to a method for producing tensile residual stress in welded pipe for creation of cracks and testing.

BACKGROUND OF THE INVENTION

In the past, workers in the fields of metallurgy and welding have attempted to prevent cracking in metallic objects. Prevention of cracking is particularly important in fields where containment is a major factor, such as the nuclear field and, to a lesser extent, the chemical and biotechnology fields. The prevention of cracking is of particular concern in connection with-pipe weld joints.

Intergranular stress corrosion cracking in metal objects, such as austenitic stainless steel pipes, typically occurs after three conditions have been fulfilled. First, the material must be susceptible to cracking, such a metal or alloy having grain-boundary carbide precipitates. Second, a portion of the metal object is under tension, such as that resulting from tensile residual stress. Third, the object is exposed to a crack-promoting environment, such as a corrosive environment or a crevice formed near the tensile-stressed area.

Because tensile stress is associated with cracking, most of the effort in the nuclear field has been concentrated on producing objects, such as pipe weld joints, which are under compressive stress. One method of producing a joint under compressive stress is to provide welding heat around the outside diameter of the pipe (at least during the last few welding passes) while cooling the interior of the pipe, such as using water. The result is a pipe weld joint which is substantially under compressive stress.

In connection with studying the cracking problem, many testing techniques have been developed. However, such testing techniques are typically hampered because of a lack of knowledge of (1) the location of tensile residual stress, or (2) the location of latent cracks. An example of such hampered testing is the technique known as "reversing D.C. crack growth monitoring," such as that discussed in "Environmental Crack Growth Measurement Techniques," a final report prepared by General Electric Co. for the Electric Power Research Institute, Report No. NP-2641, November, 1982, incorporated herein by reference. In a General Electric Nuclear Energy Company study, a predefected "dogbone" shape specimen was used for investigation. All tests were conducted on the dogbone specimens in oxygenated water in a stainless steel autoclave at $1.03\times10^7$ Pa (1500 psi) and 288 degrees Celsius. One reference and six active potential probe pairs were attached to each specimen. The specimens were subjected to uniaxially cyclic or static loads. Two defect shapes were employed. Each was an arc of a circle, one with a radius of 0.635 mm (0.025 inch) and the other with a radius equal to 1.59 mm (0.0635 inch). All defects were intended to be 0.625 mm (0.025 inch) deep. Each defect was introduced by electrical discharge machining using a single shaped electrode. After a crack had propagated to the desired dimensions and the specimen removed from the autoclave, it was fractured in the plane of the crack so that the dimensions of the crack could be measured for comparison with dimensions derived from potential drop measurements.

The section of 10.2 cm (4 inch) ID pipe that was used to demonstrate the feasibility of the reversing dc potential technique to crack measurement in components was defected by electrical discharge machining. In the pipe, as in the specimens, the aim was to position the defect and probes as accurately as possible, but in the pipe it was necessary not only to measure the distance from the end of the pipe but also to accurately space the probes circumferentially on the ID surface. According to this technique, one or more electrode pairs are positioned in the vicinity of a crack or latent crack, and reversing direct current is applied. Analysis of measured electrical characteristics provides an indication of the rate of growth of cracks. As noted, however, the electrodes are positioned adjacent the cracks or latent cracks. In a pipe, the electrodes are preferably axially positioned within about 0.15 inches of the cracks. Accordingly, these tests are hampered in situations where the location of the cracks or latent cracks, or the location of residual tensile stress, is unknown.

Another situation in which testing is hampered is in the laboratory testing of equipment which is intended for testing under bending loads. Such laboratory testing is best conducted using samples which have tensile residual stresses in known locations.

One method which has been attempted in order to produce localized cracking is to subject a metallic object to crack-promoting stress, such as a corrosive environment, only over a portion of that metallic object. However, because of the above-noted relationship of tensile residual stress, such a technique will be successful only where the localized crack-promoting stress is applied to an area of the metal object which is under tensile stress. When the location of tensile residual stress is unknown, such a technique has only a hit-or-miss success.

SUMMARY OF THE INVENTION

The present invention relates to a method for providing a metal object which has tensile residual stress in a known location. Such a provided metal object can then be used to produce localized cracking, and can be used in conjunction with several cracking investigation techniques. The method includes heating a localized area of the metal object in such a fashion that, upon cooling to ambient temperature, tensile residual stress results. This involves heating one surface of the object while cooling the opposite surface. The heating should be done in a localized area which is selected to be adjacent to an area which is substantially free from tensile residual stress. The adjacent area should be substantially unheated during the localized heating.

After the object with tensile residual stress is produced, it can be subjected to crack-promoting stresses in order to produce an object which has cracks in a localized area. This cracked object can then be used for further study. The object which is produced by the present method is useful in testing techniques, such as reversing DC crack growth studies. Since the location of tensile residual stress and/or latent cracking is known, the reversing DC electrodes can be positioned in the vicinity of the known stress or latent cracking.

Thus, although previous efforts in the field have concentrated on producing compressional stress, it has been found that a technique which results in the localization of tensile residual stresses is useful in the field, particularly in connection with testing and investigation of the cracking phenomenon.

BRIEF DESCRIPTION OF THE DRAWINGS

FIG. 3A is a side elevation section of two pipe sections being initially butt welded with a root pass;

FIG. 3B is a side elevation section of the same pipe sections filled with water having the weld completed around their periphery; and, FIG. 3C illustrates in perspective the pipe sections capped and submerged with a welding arc heating a segment on the inside of the pipe while the exterior thereof is cooled by submersion, a portion of the pipe being broken away for ease of understanding the drawing.

DETAILED DESCRIPTION OF THE PREFERRED

Figure 1:
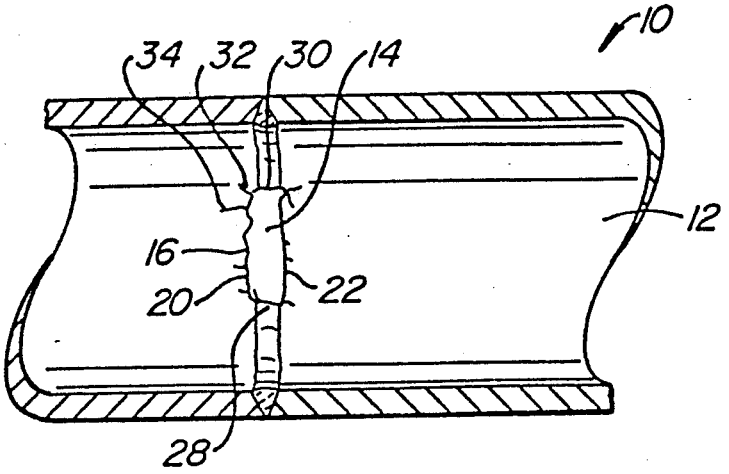
FIG. 1 is a perspective view of a pipe treated according to the present invention and subjected to dye penetration testing, with portions cut away to show an interior surface.

The present invention is particularly applicable in the field of nuclear engineering, and will be described with respect to welding of pipes useful in nuclear environments. As will be apparent to those skilled in the art, the invention has other applications not limited to the nuclear field or to piping.

A welded pipe is provided having at least a portion which is substantially free from tensile residual stress. It is necessary to have such a portion available because, if tensile residual stress were generally or randomly distributed, the area of created tensile residual stress, described below, would not have the desired locality. In the preferred embodiment illustrated in FIG. 3A, the welded pipe is produced by the method described above for producing a pipe under compressional stress. Two pipe sections 14, 16, such as type 304 stainless steel pipe, are subjected to standard welding preparation, such as beveling of the edges 20 to be joined. The pieces are initially joined using an inside diameter weld pass or root pass 21 (see FIG. 3A). Next, water 24 is provided in the interior of the pipe, such as by flowing water through the pipe, while additional welding passes 26 are made around the exterior of the joint to fill the joint in the area formed by the bevels with one or more beads of weld metal. During this operation, the exterior portion of the pipe is in a thermally expanded condition, while the interior of the pipe is maintained in a relatively cool condition. Because of this temperature differential, upon cooling of the entire pipe to ambient temperature, the exterior of the welded pipe contracts, producing compressional stress on the pipe weld.

Referring to FIG. 3C a localized area of the pipe 30, which is adjacent to the region of the pipe under compressional stress, is selected for localized heating. Preferably, this selected portion is, itself, a part of the compressional pipe joint. A localized area, which comprises about one to three inches of the linear circumferential extent of the weld, is operable for purposes of the present invention. In the preferred embodiment, a radial extent of about 45° is selected.

The selected localized area is subjected to heating along one surface, and substantially simultaneous cooling along at least a portion of the other surface in the localized area. Preferably, the interior surface of the pipe weld is heated, such as by a tungsten inert gas (TIG) electric arc torch 35, while the outside is cooled. One cooling method includes capping an end of the pipe with a cap 40 and inserting the capped end into a container of water to a depth sufficient to submerge the localized area 30. Preferably, a high-heat input is provided for the localized area, such as a linear heat input of about 20 kilojoules per centimeter (about 15 kilocalories per inch).

After the localized area is subjected to heating, as described, it is cooled to ambient temperature, such as by air-cooling. After such cooling, the area which was subjected to localized heating is in a condition of tensile residual stress.

The pipe which has been thus treated can be further treated to produce cracks in the area of tensile residual stress. This can be achieved by subjecting the pipe to crack-promoting environments and/or stresses. According to one method, the specimen is submerged in a boiling magnesium chloride solution for 72 hours, as described, in general, by ASTM Standard G36. Other methods for producing cracks include exposure to oxygenated water with formation of a crevice in the vicinity of, or adjacent to, the localized area.

Following the creation of cracks, the cracks can be investigated using a dye-penetrant test, such as that well known in the art. In general, such a test includes exposing the cracked area to a liquid dye, wiping away the excess dye, and powdering the surface adjacent to the cracks with a developer, such as talcum powder, to draw out the dye in the crack.

Figure 2:
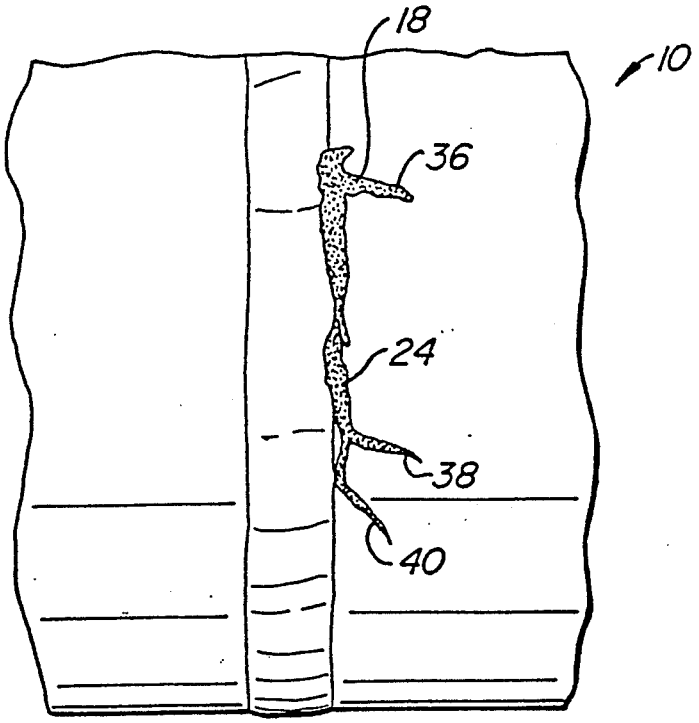
FIG. 2 is a perspective exterior view of a portion of a pipe treated according to the present invention, and subjected to dye-penetration testing.

FIG. 1 shows a pipe 10 with portions broken away to show an interior surface 12 of the pipe. The pipe 10 has been treated as described to produce a localized area 14 with tensile residual stress, and further treated, using the test described in ASTM Standard G36, to produce cracks. The cracks have been subjected to a dye-penetrant test to produce a dye pattern 16, which makes the cracks produced in the localized area 14 visible. A corresponding dye pattern 18 can also be seen in FIG. 2, which depicts the exterior surface of the pipe of FIG. 1. As can be seen from FIGS. 1 and 2, circumferential cracks 20, 22, 24 are visible on both sides of the weld. Axial cracks 28, 30, 32, 34, 36, 38, 40 are visible at either end of the localized area where the heating was started and stopped.

The pipe which has been subjected to localized heating for creation of tensile residual stress can be subjected to testing, such as reversing direct current crack growth investigations. According to this procedure, at least one electrode is attached to the pipe, such as by tack-welding in a location in or adjacent to the localized area. Because the localized area is known to be subject to tensile residual stress, and/or to have latent or apparent cracks, the electrode is, therefore, properly placed for the testing procedure. Next, a reversing direct current is applied in the region of the localized area, and electrical characteristics are measured and recorded in a manner well known for reversing direct current crack-growth tests. The recorded data are then analyzed to determine crack-growth rates, patterns, and the like.

A number of variations and modifications of the invention can be used. The invention can be used in other than nuclear fields. It can be used on metallic objects other than pipe welds. The invention can be used whenever it is desired to produce tensile residual stress, such as for purposes other than crack measurement or investigation.

Although the present invention has been described by way of the preferred embodiment and variations and modifications, other variations and modifications can also be practiced, the invention being described by the appended claims.

I claim:

1. A method for inducing localized tensile residual stress comprising in combination:

providing two pipe sections having respective beveled sections;

abutting and initially welding said pipe sections together from the outside of said pipe;

filling said abutted and initially welded pipe sections with coolant;

completing said welding of said pipe sections from the outside of said pipe to thereby produce on said pipe a compressional stress on the inside of said pipe at said weld;

capping one end of said pipe;

immersing the exterior surface of said pipe in a coolant;

heating a defined segment of said welded pipe from the inside thereof adjacent said welded surface; and, allowing said surface to cool whereby said heated segment is in a tensile residual stress for inducing cracks in said segment of said pipe adjacent said weld.

2. The method, as claimed in claim 1, wherein said pipe comprises a stainless steel pipe and said localized heating comprises providing heat energy at a linear rate of about 20 kilojoules per centimeter.

3. The method as set forth in claim 1, wherein said heating comprises heating a portion of said weld joint over a circumferential extent of less than about 45°.

4. The method, as set forth in claim 1, and including the further step of subjecting at least portions of said abutted pipes to boiling magnesium chloride.

5. The method as claimed in claim 1 and including the step of subjecting said pipe to oxygenated water.

6. The method of claim 1 and including the further step of forming a crevice adjacent to said segment.

* * * * *